US005149248A

United States Patent [19]

Cramer

[11] Patent Number: 5,149,248

[45] Date of Patent: Sep. 22, 1992

[54] APPARATUS AND METHOD FOR ADAPTING AN ENLARGED FLOW GUIDE TO AN EXISTING STEAM TURBINE

[75] Inventor: Edward P. Cramer, Charlotte, N.C.

[73] Assignee: Westinghouse Electric Corp., Pittsburgh, Pa.

[21] Appl. No.: 639,612

[22] Filed: Jan. 10, 1991

[51] Int. Cl.[5] ..... F01D 25/32

[52] U.S. Cl. ..... 415/169.2; 415/190; 415/208.2; 415/214.1; 29/889.21; 29/889.22

[58] Field of Search ..... 415/168.1, 169.1, 169.2, 415/169.3, 169.4, 183, 185, 189, 190, 208.1, 208.2, 214.1, 108; 29/889.2, 889.21, 889.22

[56] References Cited

U.S. PATENT DOCUMENTS

| | | | |
|---|---|---|---|
| 2,683,017 | 7/1954 | Gallaway | 415/214.1 |
| 3,058,720 | 10/1962 | Hart et al. | 415/169.4 |
| 3,390,830 | 7/1968 | Kahane | 415/214.1 |
| 3,628,884 | 12/1971 | Mierley, Sr. | 415/108 |
| 3,690,786 | 9/1972 | Silvestri, Jr. | 415/169.4 |
| 3,697,191 | 10/1972 | Heymann | 415/169.3 |
| 4,957,412 | 9/1990 | Olson et al. | 415/190 |

FOREIGN PATENT DOCUMENTS

| | | | |
|---|---|---|---|
| 0418887 | 3/1991 | European Pat. Off. | 415/169.4 |

*Primary Examiner*—Thomas E. Demon
*Assistant Examiner*—Christopher M. Verdier

[57] ABSTRACT

A mounting ring is provided which adapts an oversized exhaust flow guide to the existing inner cylinder of a steam turbine. The mounting ring is comprised of six arcuate segments which allow the mounting ring to be radially installed into a groove, machined in the outer diameter of the inner cylinder, despite the presence of lugs which preclude axial installation. The mounting ring and exhaust flow guide form a moisture removal gap just upstream of the tips of the last row rotating blades. Arcuate filler segments are installed in the vicinity of the horizontal joint to create a uniform moisture removal gap around the circumference of the steam flow path. The mounting ring creates an access space above the horizontal joint flanges in the cover half of the innert cylinder for installation of the horizontal joint bolts.

15 Claims, 6 Drawing Sheets

APPARATUS AND METHOD FOR ADAPTING AN ENLARGED FLOW GUIDE TO AN EXISTING STEAM TURBINE

BACKGROUND OF THE INVENTION

The current invention concerns an apparatus and method for adapting an exhaust flow guide having an enlarged diameter to an existing steam turbine inner cylinder. More specifically, the current invention concerns a multi-segmented mounting ring which allows an oversized exhaust flow guide to be securely mounted and accurately aligned to an existing inner cylinder and which provides a moisture removable slot upstream of the last row of blades.

The power output of an existing low pressure steam turbine can be increased by a retrofit which includes increasing the length of the last row of rotating blades. However, since such blades are enclosed by an exhaust flow guide, the original flow guide must be replaced by an oversized one—that is, an exhaust flow guide having a enlarged diameter. Unfortunately, as a result of its larger diameter, the oversized exhaust flow guide cannot be mounted onto the inner cylinder by bolting it to the face of the inner cylinder, as was done with the original exhaust flow guide.

One method for adapting an oversized exhaust flow guide to an existing inner cylinder is disclosed in U.S. Pat. No. 4,900,223, assigned to the same assignee as the current invention. According to this approach, a spacer is installed between the exhaust flow guide and the inner cylinder. The spacer is supported by, and aligned to, the inner cylinder by an undercut, formed on the inner diameter of the spacer, which rests against the outside diameter of the inner cylinder. The spacer is also supported by bosses welded to the end wall of the inner cylinder.

Unfortunately, the approach disclosed in U.S. Pat. No. 4,900,223 suffers from several drawbacks. First, resting the spacer ring against the outside diameter of the inner cylinder does not provide an accurate surface for aligning the spacer, and hence the exhaust flow guide. This is so because the outer diameter of the inner cylinder is not accurately located as a result of the inner cylinder being a fabricated component. Second, since the inner cylinder end wall is also not accurately located, the bushings welded to it may not be axially aligned around the circumference, thereby providing a non-uniform support surface for the exhaust flow guide. Third, no means are provided for removing moisture from the steam upstream of the last row blades, so as to avoid erosion of the blade tips.

Consequently, it would be desirable to provide an apparatus and method for adapting an enlarged diameter exhaust flow guide to an existing steam turbine inner cylinder which allowed accurate alignment and uniform support of the exhaust flow guide and which provided for moisture removable upstream of the last row rotating blades.

SUMMARY OF THE INVENTION

It is an object of the current invention to provide an apparatus and method for adapting an exhaust flow guide of enlarged diameter to an existing inner cylinder in a steam turbine.

It is another object of the current invention that the exhaust flow guide be accurately aligned and securely mounted to the inner cylinder despite the fact that the inner cylinder is a fabricated component whose geometry is not accurately located.

It is still another object of the invention that the apparatus allow moisture to be removed from the steam flow upstream of the last row rotating blades.

These and other objects are accomplished in a steam turbine having an inner cylinder comprised of cover and base halves joined at a horizontal joint by flanges. A mounting ring, comprised of arcuate segments having lips and grooves on their inside diameter, is mated with a lip and groove specially machined in the outside diameter of the inner cylinder. Thus, the mounting segments can be accurately aligned in both the axial and radial directions despite variations in the location of the inner cylinder outer diameter as originally fabricated. The mounting segments are bolted to the inner cylinder end wall and are axially supported at their outer edge by threaded plugs screwed into tapped holes in the end wall. Since the axial position of the threaded plugs can be adjusted, the mounting ring can be securely supported and accurately aligned despite variations in the axial position of the end wall around the circumference of the inner cylinder. The exhaust flow guide is mounted by bolting its vertical flange to the downstream face of the mounting ring.

The ends of the mounting ring stop short of the horizontal joint flanges in the inner cylinder cover half, thereby providing an access space for installation and removal of the horizontal joint bolts.

Spacer washers, disposed between the exhaust flow guide vertical flange and the downstream face of the mounting ring, form a gap between the exhaust flow guide and the mounting ring just upstream of the last row blades. This gap serves to remove moisture from the steam flow, thereby preventing erosion of the last row blades. Arcuate filler segments extending around the horizontal joint flanges are welded to the inner cylinder and maintain a uniform moisture removal gap around the circumference of the steam flow path.

DESCRIPTION OF THE PREFERRED EMBODIMENT

Figure 1:
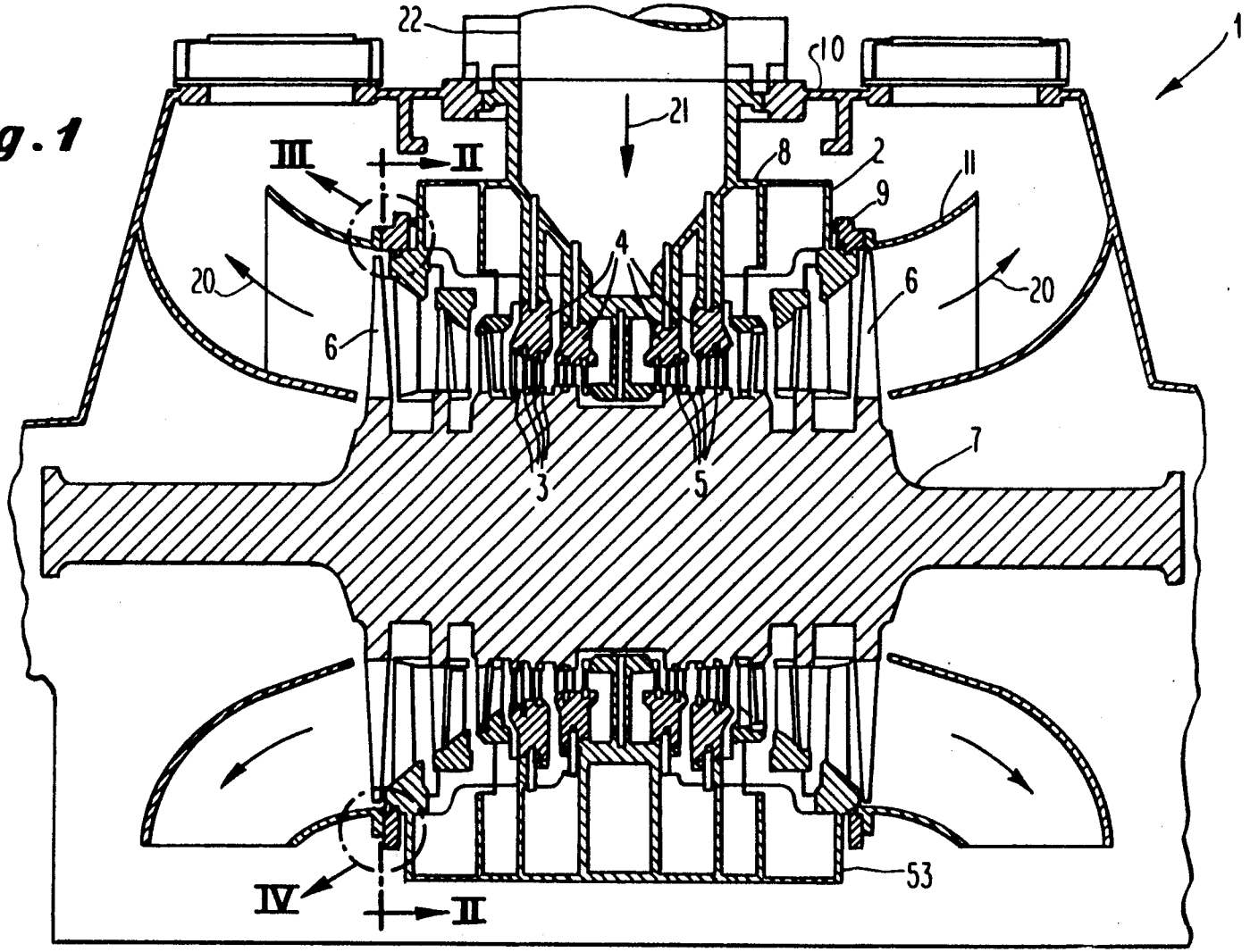
FIG. 1 is a longitudinal cross-section of a steam turbine.

There is shown in FIG. 1 a longitudinal cross-section of a low pressure steam turbine 1. The primary components of the steam turbine are an outer cylinder 10, an inner cylinder 8 enclosed by the outer cylinder 10, and a centrally disposed rotor 7 enclosed by the inner cylinder 8. The inner cylinder 8 and rotor 7 form an annular steam flow path therebetween, the inner cylinder forming the outer periphery of the flow path. Blade rings 4 are attached to the inside surface of the inner cylinder 8. A plurality of stationary vanes 5 and rotating blades 3 are arranged in alternating rows and extend into the steam flow path. The vanes 5 are affixed to the blade rings 4 and the blades 3 are affixed to the periphery of the rotor 7.

An approximately cone-shaped exhaust flow guide 11 is disposed at each end of the inner cylinder 8. The exhaust flow guides are comprised of upper and lower halves joined at a horizontal joint. Steam 21 enters the steam turbine 1 through an inlet 22 formed at the top of the outer cylinder 10. The steam is split into two streams, each flowing axially outward from the center of the steam turbine through the aforementioned steam flow path, thereby imparting energy to the blades 3. The exhaust flow guide 11 guides the steam 20 exiting the inner cylinder 8 to an outlet, not shown, in the outer cylinder 10. As explained below, the steam turbine 1 shown in FIG. 1 has been retrofitted with an oversized exhaust flow guide 11 in order to allow the use of longer blades 6 in the last rows -that is, the downstream-most rows of blades. Such use of longer last row blades 6 increases the power output of the steam turbine 1.

Figure 3:
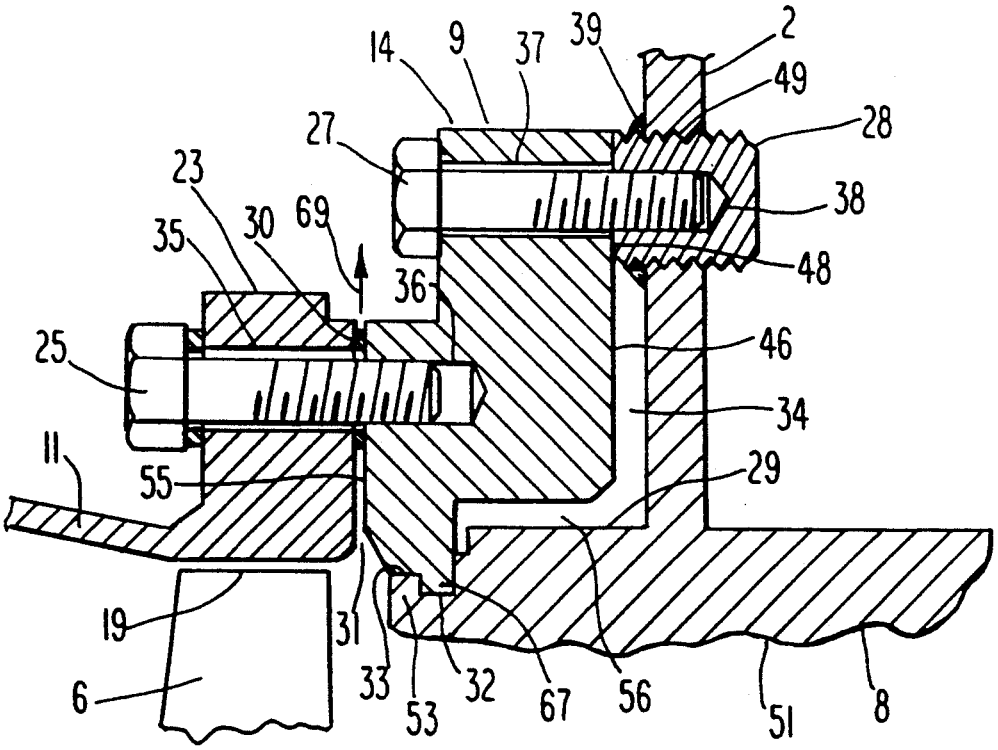
FIGS. 3 and 4 are details of the steam turbine cross-section shown in FIG. 1 in the vicinity of the exhaust flow guide vertical flange in the cover and base halves of the inner cylinder, respectively, as indicated by the circles denoted III and IV in FIG. 1.
Figure 4:
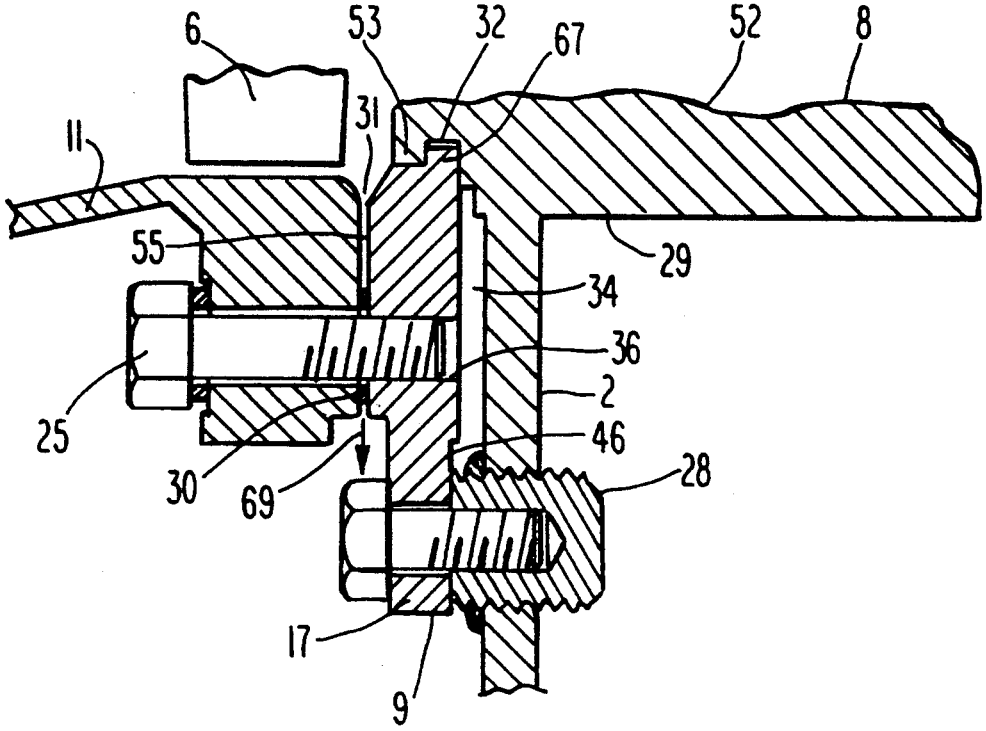

As shown in FIG. 1, a mounting ring 9 is used to adapt the oversized exhaust flow guide 11 to the existing cylinder 8. As shown in FIGS. 3 and 4, the inner cylinder 8 has a groove 32 and lip 53 machined into its outer diameter 29. Likewise, the mounting ring 9 has a groove 33 and a lip 67 machined in its inner diameter. The mounting ring 9 is mounted on the inner cylinder 8 by radially inserting the mounting ring lip 67 into the inner cylinder groove 32. The diameter of the mounting ring groove 33 is of essentially the same diameter as the inner cylinder lip 53, so that the two components accurately mate with each other. It is important to note that the inner cylinder 8 is a fabrication—that is, a combination of components welded together. As such, its geometry is not accurately defined within close tolerances. Thus, specially machining the groove 32 and lip 53 into an existing inner cylinder 8 creates an accurately located mounting surface which allows the mounting ring to be accurately aligned to the inner cylinder 8 in both the axial and radial directions.

Note that a radial 56 clearance gap is provided between the inner cylinder outer diameter 29 and the portion of the mounting ring 9 remote from the mating lips and grooves 32, 33, 53, 67. Similarly, an axial clearance gap 34 is provided between the end wall 2 and the portion of the mounting ring 9 remote from the mating lips and grooves 32, 33, 53, 67. These clearance gaps ensure that, regardless of variations in the inner cylinder 8 due to the tolerances associated with such fabrications, the aforementioned mating lips and grooves, and the bosses 28 discussed below, can provide the locating surfaces for the mounting ring 9, without interference from other, less accurately located, portions of the inner cylinder 8.

Figure 2:
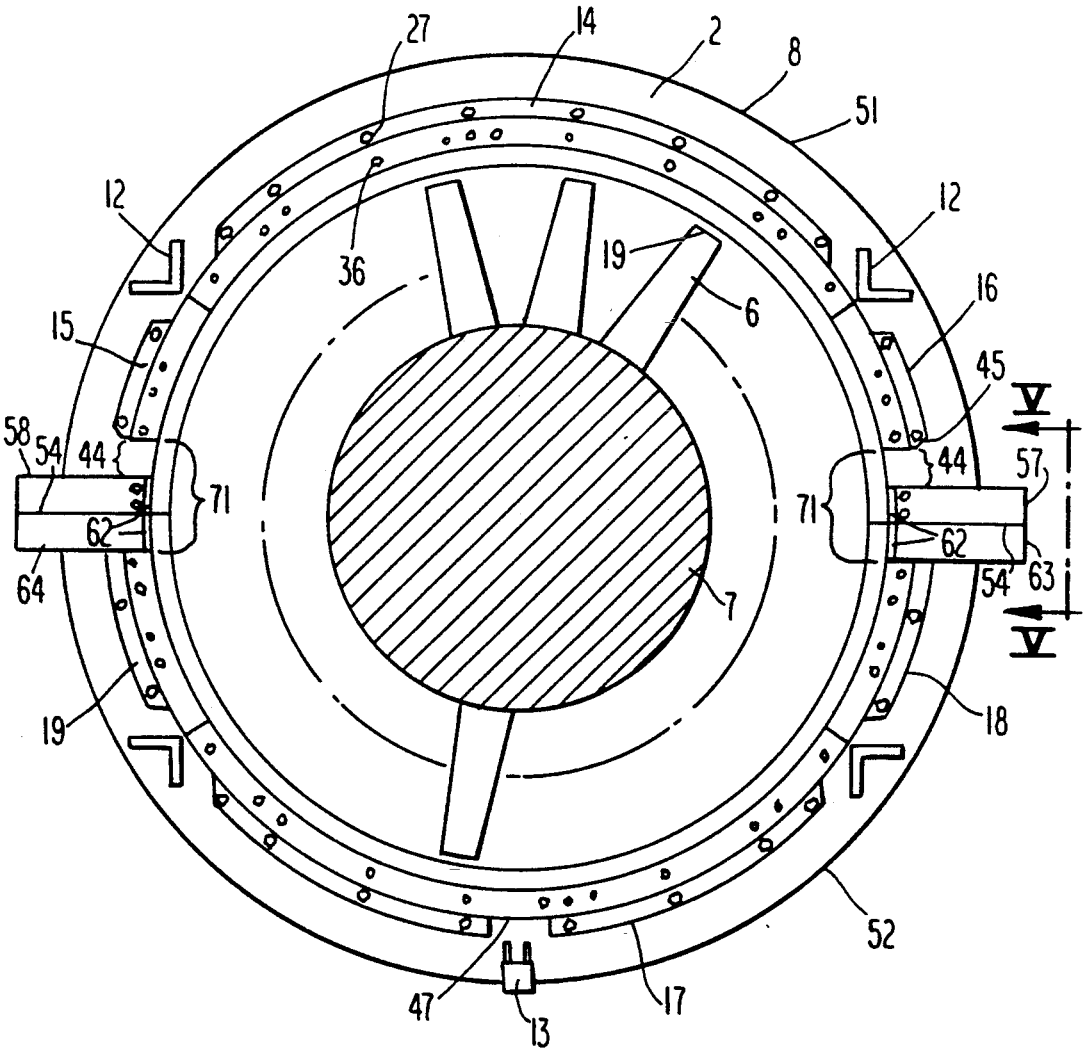
FIG. 2 is a cross-section taken through line II—II shown in FIG. 1, showing the inner cylinder, mounting ring, last row blades, and rotor as seen looking against the direction of steam flow.

According to the current invention, the mounting ring 9 is also attached to the inner cylinder at the outer edge of the mounting ring. This is accomplished by drilling and tapping holes 49 in the end wall 2 of the inner cylinder 8. As shown in FIGS. 2, 3 and 4, the end wall 2 is a circumferentially extending radially oriented member, the holes 49 being arrayed around the circumference of the end wall. A threaded plug 28 is screwed into each hole 49, thereby forming a mounting boss for the mounting ring 9. As shown in FIGS. 3 and 4, the mounting ring 9 has upstream 46 and downstream 55 circumferentially extending radially oriented faces. The upstream face 46 is supported against the axial faces 48 of the threaded plugs 28. To account for variations in the axial position of the end wall 2 about its circumference, the axial position of the threaded plug faces 48 can be adjusted by screwing or unscrewing the threaded plugs into the holes 49 in the end wall. Thus, the threaded plugs 28 provide a second, and adjustable, means for axially supporting and aligning the mounting ring 9. Once the proper positioning of the mounting ring 9 is attained, the threaded plugs 28 are locked in place by weld bead 39. The mounting ring is affixed to the threaded plugs 28 by bolts 27 penetrating through holes 37 formed in the mounting ring 9 and secured into tapped holes 38 in the threaded plugs.

After the mounting ring 9 has been securely and properly mounted on the inner cylinder 8, the exhaust flow guide 11 is mounted to the downstream face 55 of the mounting ring. Since, as explained above, the mounting ring 9 is accurately aligned, the exhaust flow guide 11 which mounts on it will also be accurately aligned. The exhaust flow guide 11 is mounted by bolts 25 which penetrate through holes 35 arranged around a circumferentially extending vertical flange 23 formed in the exhaust flow guide 11. The bolts 25 are threaded into tapped holes 36 in the mounting ring 9. According to an important aspect of the current invention, spacer washers 30 are disposed between the exhaust flow guide vertical flange 23 and the mounting ring downstream face 55 at each bolt 25 location, each bolt protruding through a hole in the spacer washer 30. Thus, the spacer washers 30 form a circumferentially extending axial gap 31 between the exhaust flow guide 11 and the mounting ring 9 which serves to remove moisture from the steam flow.

As is well known in the art, there is a tendency for water droplets to form in the steam flowing through the lowest pressure portions of low pressure steam turbines. These water droplets are entrained in the steam flow and, as a result of centrifugal force, migrate outward toward the tips of the blades. These water droplets can cause harmful erosion of the tips 19 of the last row blades 6. As shown in FIGS. 3 and 4, the gap 31 is disposed just upstream of the tips 61 of the last row blades 6 and is thus ideally located to draw moisture radially out of the steam flow. The moisture 69 thus removed mixes with the exhaust steam 21 downstream of the exhaust flow guide 11. Note that it is important that the gap 31 be wide enough to allow moisture to be drawn through the gap yet not so large as to cause an excessive power loss due to steam flow bypassing the last row blades 6. In the preferred embodiment, the gap 31 is approximately 0.318 cm (0.125 inch) wide.

Once the exhaust flow guide 11 installation is completed, the bolts 25 and 27 may be locked in place by a weld bead, not shown, deposited around their heads.

Figure 5:
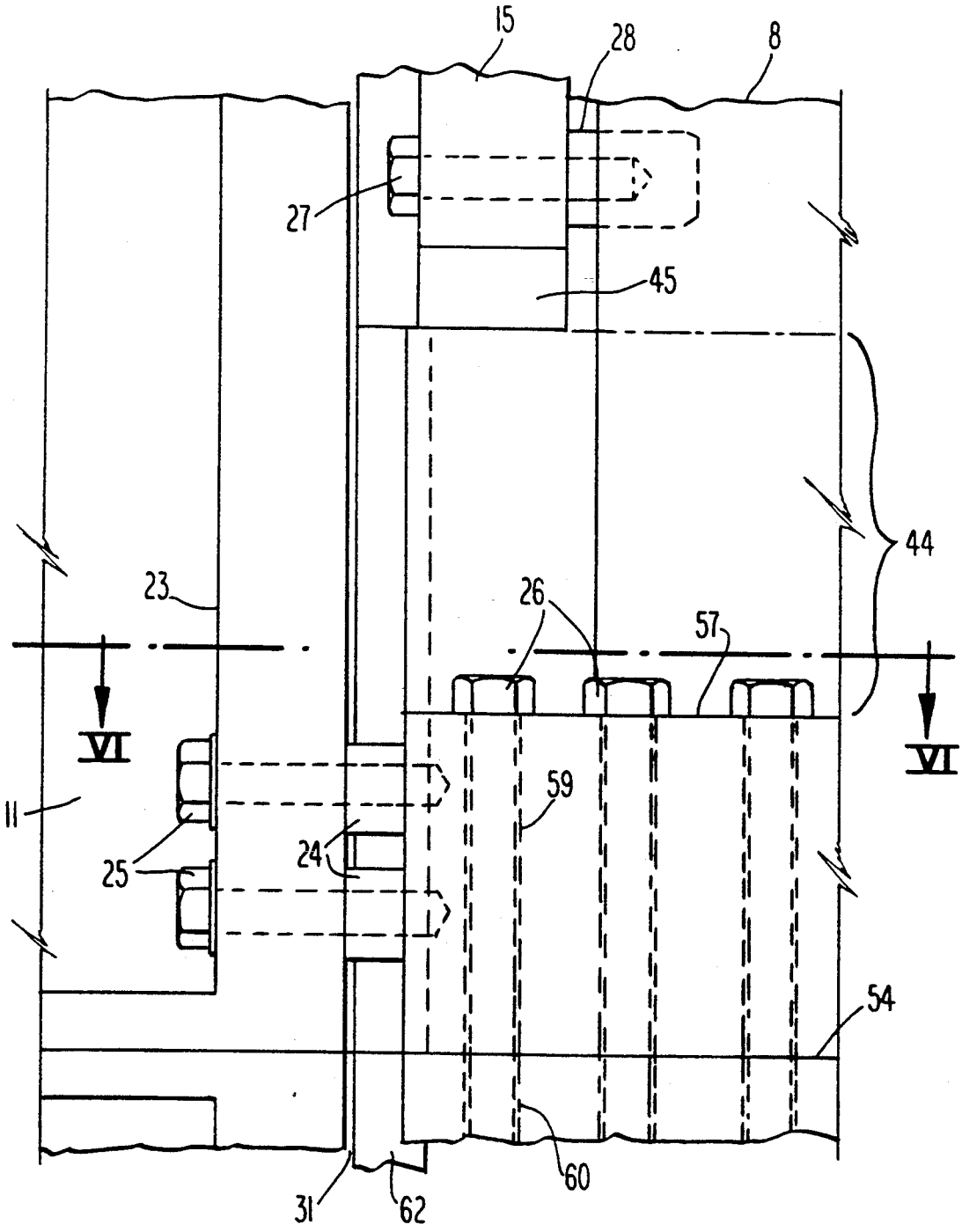
FIG. 5 shows the horizontal joint area of the inner cylinder viewed from line V—V shown in FIG. 2.

As shown in FIG. 2, the inner cylinder 8 is comprised of a cover half 51 and a base half 52 joined along a horizontal joint 54. The cover and base halves are joined at the horizontal joint by longitudinally extending mating right hand flanges 57, 63 and mating left hand flanges 58, 64 in the cover and base halves, respectively. The flanges are pressed together by bolts 26 penetrating through holes 59 in the cover half flanges 57, 58 and screwed into tapped holes 60 in the base half flanges 63, 64, as shown in FIG. 5.

As shown in FIG. 2, according to an important aspect of the current invention, the mounting ring 9 is comprised of six arcuate mounting segments circumferentially arrayed around the inner cylinder 8. Mounting segments 14, 15, 16 are disposed at the top, left and right sides of the inner cylinder cover half 51, respectively. Mounting segments 17, 18, 19 are disposed at the bottom, right and left sides of the inner cylinder base half 51, respectively. As can be seen in FIG. 2, lifting lugs 12 and an alignment lug 13 protrude from the inner cylinder end wall 2. These lugs preclude installing a mounting ring comprised of only cover and base portions by moving it into position in the radial direction. Unfortunately, as a result of the fact that the mounting ring 9 and inner cylinder 8 mate via grooves and lips 32, 33, 53, 67, the mounting ring Can only be installed by moving it into position in the radial direction. However, as a result of splitting the mounting ring 9 into six segments according to the current invention, there is sufficient access to radially install the mounting ring despite the presence of the lifting lugs 12 and the alignment lug 13. Note that a cut-out 47 is formed in mounting segment 17 to provide clearance around the alignment lug 13.

As shown in FIGS. 3 and 4, the inner cylinder end wall 2 is displaced upstream in the cover half 51 relative to the base half 52 in order to allow access for the horizontal joint bolts 26. As a result, the thickness of the segments 17, 18, 19 in the base half is less than that of the segments 14, 15, 16 in the cover half so as to compensate for the axial displacement of the end wall 2.

Figure 7:
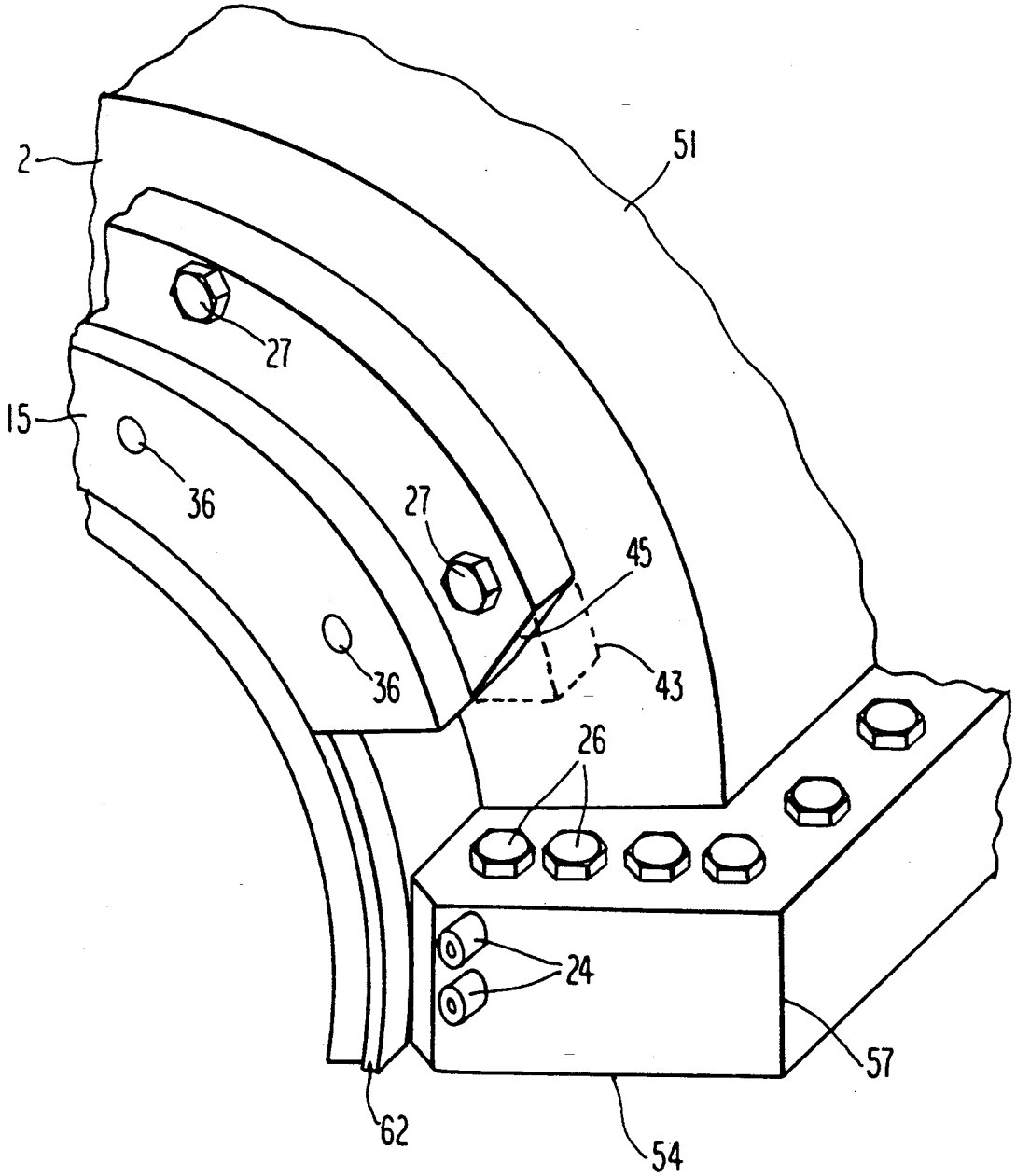
FIG. 7 is an isometric view of the inner cylinder in the vicinity of the right horizontal joint, shown prior to installing the exhaust flow guide.

As shown in FIG. 2, in the base half 52 of the inner cylinder 8, the right and left segments 18, 19 extend to the horizontal joint flanges 63, 64. However, in the cover half 51, the right and left segments 15, 16 stop short of the flanges 57, 58, thereby forming an access space 44 which allows withdrawal and insertion of the horizontal joint bolts 26, as shown in FIGS. 2, 5 and 7. Moreover, a chamfer 45 is formed on segments 15 and 16 by removing a portion 43 of these segments on their ends nearest the flanges, as shown in FIG. 7, to further increase the bolt access space.

Thus, as shown in FIGS. 2 and 7, the mounting ring 9 extends over only a portion of the circumferential extent of the inner cylinder end wall 2 and exhaust flow guide vertical flange 23, specifically, the portion away from the horizontal joint flanges 57, 58, 63, 64. Therefore, the mounting ring 9 forms the moisture removal gap 31 over only a portion of the circumferential extent of the exhaust flow guide vertical flange 23. In the remaining portion of the vertical flange 23, the gap 31 is formed by arcuate filler segments 62 which extend around the horizontal joint flanges 57, 58, 63, 64 and butt against the faces of the side mounting segments 15, 16, 18, 19, as shown in FIG. 2. Note that there are four filler segments 62, one each for both the right and left hand flanges in both the cover and base halves.

Figure 6:
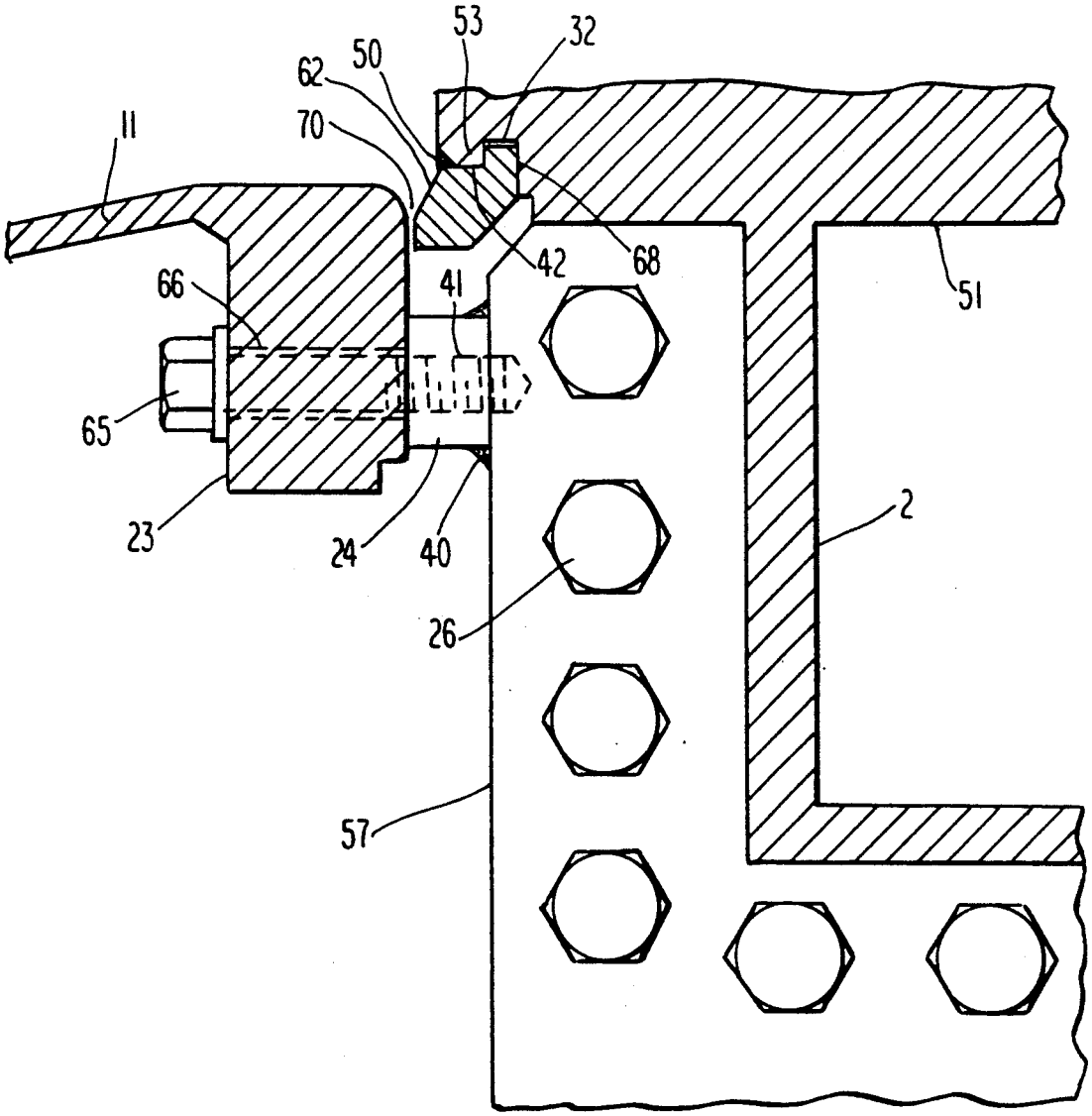
FIG. 6 is a cross-section taken through line VI—VI shown in FIG. 5, showing the cover half of the inner cylinder and exhaust flow guide in the vicinity of the horizontal joint.

As shown in FIG. 6, a groove 42 and lip 68 are machined in the inner diameter of each filler segment 62, allowing them to mate with groove 32 and lip 53 in the inner cylinder 8 so that they, like the mounting ring 9, are accurately aligned in both the axial and radial directions. The filler segments 62 are retained in the inner cylinder by a weld bead 50. The downstream faces of the filler segments 62 form a circumferentially extending axial gap 70 between them and the exhaust flow guide vertical flange 23 in the vicinity of the horizontal joint. The width of the filler segments 62 is such that gap 70 is the same width as gap 31 formed by the mating ring 9 over other portions of the vertical flange circumference. Thus, gaps 31 and 70 form a continuous moisture removal gap. Over portions of the vertical flange 23 circumference remote from the horizontal joint flanges, the moisture removal gap is formed between the vertical flange and the mounting ring 9, whereas in portions of the vertical flange circumference around the horizontal joint flanges, the moisture removal gap is formed between the vertical flange and the filler segments 62.

Thus, the filler segments 62 ensure that a uniform moisture removal gap 31 is maintained around the entire circumference of the exhaust flow guide 11, thereby preventing an excessive quantity of steam from bypassing the last row blades 6. It should also be noted that, were it not for the filler segments 62, the large gap between the inner cylinder 8 and the exhaust flow guide vertical flange 23 at the horizontal joint 54 would result in undesirable vibratory excitation of the last row blades 6 due to discontinuities in the steam flow around the circumference of the flow path.

As shown in FIG. 2, a circumferential gap 71, spanning the horizontal joint 54, is formed between mounting segments 16 and 18 and between mounting segments 15 and 19. Consequently, the mounting ring 9 does not provide support for the exhaust flow guide 11 in the vicinity of the horizontal joint 54. Thus, according to the current invention, bushings 24 are affixed to the vertical faces of the horizontal joint flanges 57, 58 in the inner cylinder cover half 51 by weld beads 40, as shown in FIGS. 6 and 7. The exhaust flow guide vertical flange 23 is supported against the axial face of the bushings 24 by bolts 65 which protrude through holes 66 in the vertical flange 23 and are screwed into tapped holes 41 extending through the bushing 24 and into the flanges 57, 58.

The present invention may be embodied in other specific forms without departing from the spirit or central attributes thereof and, accordingly, reference should be made to the appended claims, rather than to the foregoing specification, as indicating the scope of the invention.

I claim:

1. A steam turbine comprising:

a) an inner cylinder having an inner diameter forming a first portion of a steam flow path and an outer diameter in which a lip and groove are formed;

b) an exhaust flow guide having an inner surface forming a second portion of said steam flow path downstream of said first portion, said exhaust flow guide inner surface having a minimum diameter, said minimum diameter being greater than said inner diameter of said inner cylinder;

c) an adapter for mounting said exhaust flow guide to said inner cylinder and having an inner diameter in which a lip and groove are formed for mating with said inner cylinder lip and groove so as to align said adapter to said inner cylinder in both the axial and radial directions, said adapter disposed between said exhaust flow guide and said inner cylinder; and d) axially adjustable support surfaces for axially aligning said mounting adapter to said inner cylinder.

2. The steam turbine according to claim 1 wherein said mounting adapter comprises a plurality of arcuate mounting members.

3. The steam turbine according to claim 2 wherein a gap is formed between said mounting members and said inner cylinder in portions of said mounting members remote from said lip and groove.

4. The steam turbine according to claim 1 wherein said axially adjustable support surfaces comprise a plurality of threaded holes formed in said inner cylinder and a threaded plug for each of said threaded holes.

5. A steam turbine comprising:

a) an inner cylinder forming a first portion of a steam flow path, said inner cylinder having a base half and a cover half joined along a horizontal joint by mating longitudinally extending flanges, a right and left one of said flanges formed in each of said base and cover halves, and a plurality of bolts for pressing said mating flanges together;

b) an exhaust flow guide forming a second portion of said steam flow path downstream of said first portion;

c) an adapter for mounting said exhaust flow guide to said inner cylinder, said adapter disposed between said exhaust flow guide and said inner cylinder, said adapter forming an access space adjacent each of one of said right and each of one of said left flanges for removing said bolts; and d) a plurality of spacers disposed between said adapter and said exhaust flow guide forming a first moisture removal gap therebetween.

6. The steam turbine according to claim 5 wherein said exhaust flow guide and said inner cylinder form a gap therebetween in the vicinity of said horizontal joint and further comprising a filler piece disposed in said gap between said exhaust flow guide and said inner cylinder.

7. The steam turbine according to claim 6 wherein said filler piece is comprised of a plurality of arcuate filler members.

8. The steam turbine according to claim 6 wherein said inner cylinder and said filler piece have mating lips and grooves formed therein for radially and axially aligning said filler piece to said inner cylinder.

9. The steam turbine according to claim 6 wherein said filler piece is welded to said inner cylinder.

10. The steam turbine according to claim 6 wherein said filler piece and said exhaust flow guide form a second moisture removal gap therebetween.

11. The steam turbine according to claim 10 wherein the combination of said first and second moisture removal gaps forms a continuous moisture removal gap around the entire circumference of said steam flow path.

12. In a steam turbine having an annular flow path bounded at its outer periphery by an inner cylinder and a flow guide, said flow guide having a diameter larger than the flow guide for which said steam turbine was originally designed, a plurality of rotating blades arranged in rows disposed within said flow path, said inner cylinder having a circumferentially extending wall, said flow guide having a circumferentially extending vertical flange, an apparatus for mounting said flow guide vertical flange to said inner cylinder wall and for removing moisture from said flow path, comprising:

a) a plurality of first arcuate members arranged between said inner cylinder wall and said flow guide vertical flange along a first portion of the circumferential extent of said flow guide vertical flange, said first arcuate members and said flow guide forming a first circumferentially extending gap therebetween, said first arcuate members having an inner diameter;

b) a plurality of second arcuate members arranged between said inner cylinder and said flow guide vertical flange along a second portion of the circumferential extent of said flow guide vertical flange, said second arcuate members and said flow guide forming a second circumferentially extending gap therebetween;

c) a plurality of bosses formed in said inner cylinder wall, said bosses having faces and means for adjusting the axial position of said faces, said first arcuate members supported against said faces; and d) a lip machined in said inner cylinder outer diameter and a mating groove machined in said inner diameter of said first arcuate members.

13. The apparatus according to claim 12 wherein:

a) said inner cylinder comprises cover and base halves, each of said cover and base halves having two longitudinally extending flanges; and b) said second portion of the circumferential extent of said flow guide vertical flange extends around said inner cylinder longitudinally extending flanges.

14. The apparatus according to claim 13 further comprising a plurality of bushings disposed between said flow guide vertical flange and said inner cylinder longitudinally extending flanges, each of said bushings having an axially oriented face, said flow guide vertical flange supported against said bushing faces.

15. In a steam turbine inner cylinder having a circumferentially extending radially oriented wall and an outer diameter, a method of installing an enlarged exhaust flow guide, comprising the steps of:

a) machining a lip in said outer diameter of said inner cylinder;

b) drilling and tapping a plurality of holes in said wall;

c) installing a threaded plug having a face in each of said holes;

d) mounting a plurality of arcuate segments onto said inner cylinder, each of said arcuate segments having a groove mating with said lip, and having upstream and downstream circumferentially extending radially oriented faces;

e) adjusting the axial position of each of said threaded plugs by rotating said threaded plugs within said threaded holes until said face of each of said threaded plugs bears against said upstream face of one of said arcuate segments; and f) mounting said exhaust flow guide onto said downstream face of said arcuate segments.

* * * * *